US006347812B1

(12) United States Patent
Herman

(10) Patent No.: US 6,347,812 B1
(45) Date of Patent: Feb. 19, 2002

(54) CHECK WRITING SYSTEM

(76) Inventor: Tom Herman, 3247 S Barcelona St., Spring Valley, CA (US) 91977

( * ) Notice: Subject to any disclaimer, the term of this patent is extended or adjusted under 35 U.S.C. 154(b) by 0 days.

(21) Appl. No.: 09/822,142

(22) Filed: Mar. 30, 2001

(51) Int. Cl.[7] ..... B42D 15/00
(52) U.S. Cl. ..... 283/58; 283/57; 402/73; 281/29; 281/37
(58) Field of Search ..... 283/57, 58, 56, 283/115, 117, 61, 62; 402/70, 73, 79; 281/29, 31, 36, 51, 37

(56) References Cited

U.S. PATENT DOCUMENTS

| | | | | |
|---|---|---|---|---|
| 3,254,906 A | | 6/1966 | Moss | |
| 3,278,200 A | | 10/1966 | Scully | |
| 4,014,566 A | | 3/1977 | Cantrell et al. | |
| 4,225,157 A | * | 9/1980 | Hamacher | 283/58 X |
| 4,332,400 A | | 6/1982 | Hayman | |
| 4,614,362 A | * | 9/1986 | Breen et al. | 283/58 X |
| 4,684,154 A | | 8/1987 | Hayman et al. | |
| 5,277,451 A | * | 1/1994 | Garza | 283/58 X |
| D405,605 S | | 2/1999 | Zimmerman | |
| 5,944,351 A | * | 8/1999 | Koploy | 283/58 X |

* cited by examiner

*Primary Examiner*—Willmon Fridie, Jr.

(57) ABSTRACT

A check writing system for providing a compact convenient system for carrying checks. The check writing system includes a main cover member which includes a front surface and a back surface and is used substantially to provide rigidity for the check writing system to facilitate writing checks, a plurality of check blanks each of which is detachably coupled to the main cover member, and a front cover member which is coupled to the main cover member and used to provide protection for the plurality of check blanks from creasing, stray marks, and wear due to rubbing.

7 Claims, 2 Drawing Sheets

CHECK WRITING SYSTEM

BACKGROUND OF THE INVENTION

1. Field of the Invention

The present invention relates to checkbooks and more particularly pertains to a new check writing system for providing a compact convenient system for carrying checks.

2. Description of the Prior Art

The use of checkbooks is known in the prior art. More specifically, checkbooks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,254,906; U.S. Pat. No. 4,014,566; U.S. Pat. No. 4,332,400; U.S. Pat. No. 3,278,200; U.S. Pat. No. 4,684,154; and U.S. Pat. No. Des. 405,605.

While these devices fulfill their respective, particular objectives and requirements, the aforementioned patents do not disclose a new check writing system. The inventive device includes a main cover member which includes a front surface and a back surface and is used substantially to provide rigidity for the check writing system to facilitate writing checks, a plurality of check blanks each of which is detachably coupled to the main cover member, and a front cover member which is coupled to the main cover member and used to provide protection for the plurality of check blanks from creasing, stray marks, and wear due to rubbing.

In these respects, the check writing system according to the present invention substantially departs from the conventional concepts and designs of the prior art, and in so doing provides an apparatus primarily developed for the providing a compact convenient system for carrying checks.

SUMMARY OF THE INVENTION

In view of the foregoing disadvantages inherent in the known types of checkbooks now present in the prior art, the present invention provides a new check writing system construction wherein the same can be utilized for providing a compact convenient system for carrying checks.

The general providing a compact convenient system for carrying checks of the present invention, which will be described subsequently in greater detail, is to provide a new check writing system apparatus and method which has many of the advantages of the checkbooks mentioned heretofore and many novel features that result in a new check writing system which is not anticipated, rendered obvious, suggested, or even implied by any of the prior art checkbooks, either alone or in any combination thereof.

To attain this, the present invention generally comprises a main cover member which includes a front surface and a back surface and is used substantially to provide rigidity for the check writing system to facilitate writing checks, a plurality of check blanks each of which is detachably coupled to the main cover member, and a front cover member which is coupled to the main cover member and used to provide protection for the plurality of check blanks from creasing, stray marks, and wear due to rubbing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the providing a compact convenient system for carrying checks of description and should not be regarded as limiting.

As such, those skilled in the art will appreciate that the conception, upon which this disclosure is based, may readily be utilized as a basis for the designing of other structures, methods and systems for carrying out the several providing a compact convenient system for carrying checks of the present invention. It is important, therefore, that the claims be regarded as including such equivalent constructions insofar as they do not depart from the spirit and scope of the present invention.

Further, the providing a compact convenient system for carrying checks of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new check writing system apparatus and method which has many of the advantages of the checkbooks mentioned heretofore and many novel features that result in a new check writing system which is not anticipated, rendered obvious, suggested, or even implied by any of the prior art checkbooks, either alone or in any combination thereof.

It is another object of the present invention to provide a new check writing system which may be easily and efficiently manufactured and marketed.

It is a further object of the present invention to provide a new check writing system which is of a durable and reliable construction.

An even further object of the present invention is to provide a new check writing system which is susceptible of a low cost of manufacture with regard to both materials and labor, and which accordingly is then susceptible of low prices of sale to the consuming public, thereby making such check writing system economically available to the buying public.

Still yet another object of the present invention is to provide a new check writing system which provides in the apparatuses and methods of the prior art some of the advantages thereof, while simultaneously overcoming some of the disadvantages normally associated therewith.

Still another object of the present invention is to provide a new check writing system for providing a compact convenient system for carrying checks.

Yet another object of the present invention is to provide a new check writing system which includes a main cover member which includes a front surface and a back surface and is used substantially to provide rigidity for the check writing system to facilitate writing checks, a plurality of check blanks each of which is detachably coupled to the main cover member, and a front cover member which is coupled to the main cover member and used to provide protection for the plurality of check blanks from creasing, stray marks, and wear due to rubbing.

Still yet another object of the present invention is to provide a new check writing system that can be discretely carried by the user.

Even still another object of the present invention is to provide a new check writing system that eliminates the need to carry a separate wallet and checkbook.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
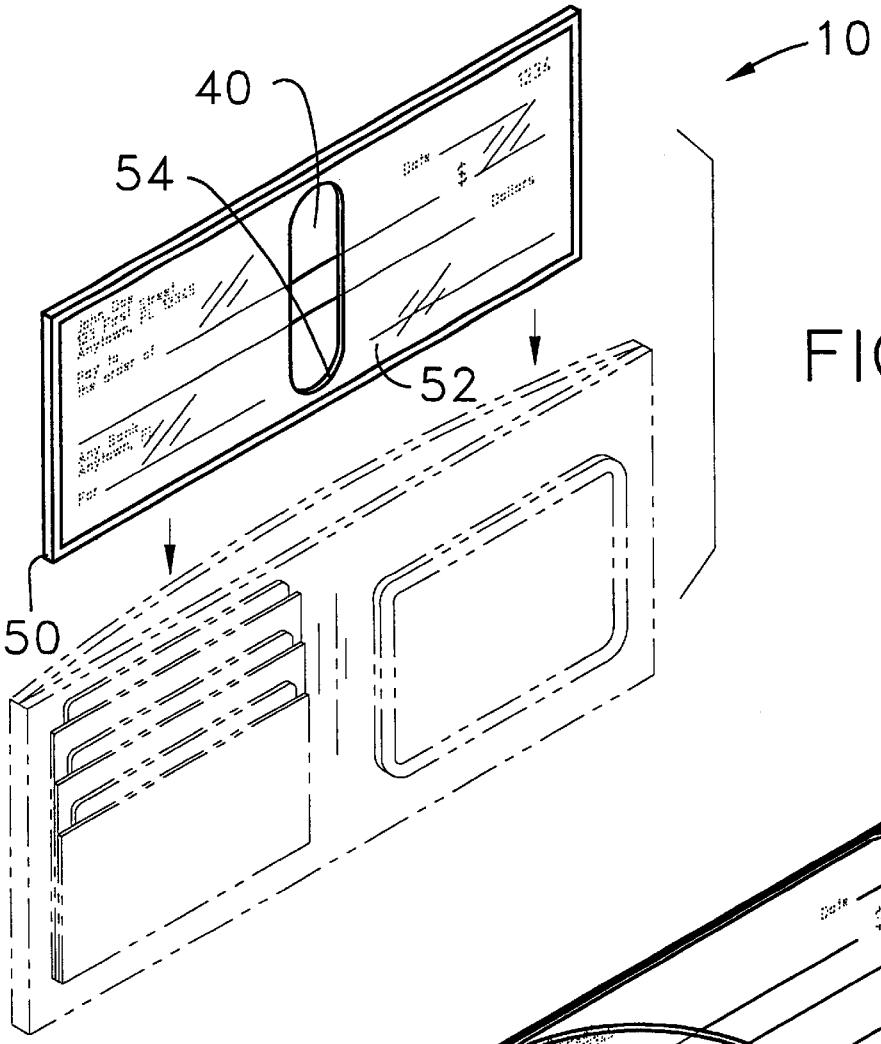
FIG. 1 is a schematic perspective view of a new check writing system according to the present invention.
Figure 2:
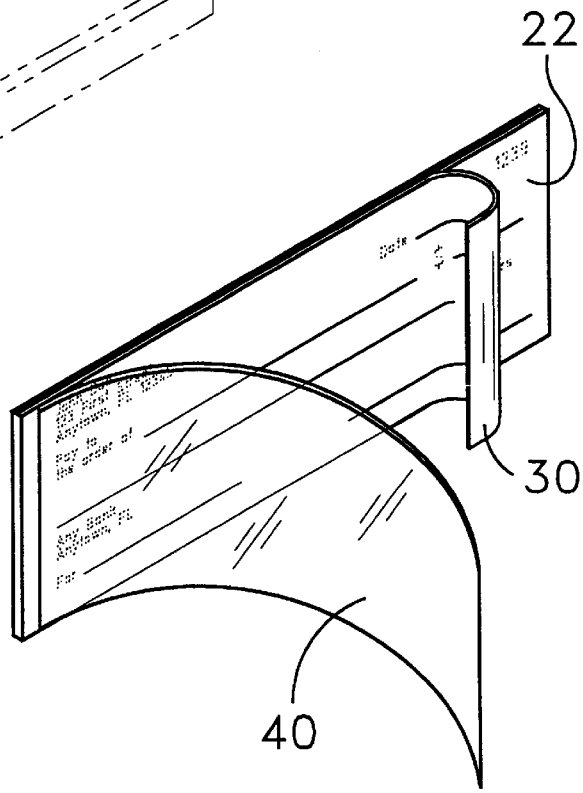
FIG. 2 is a schematic perspective view of the front cover and plurality of check blanks of the present invention.
Figure 3:
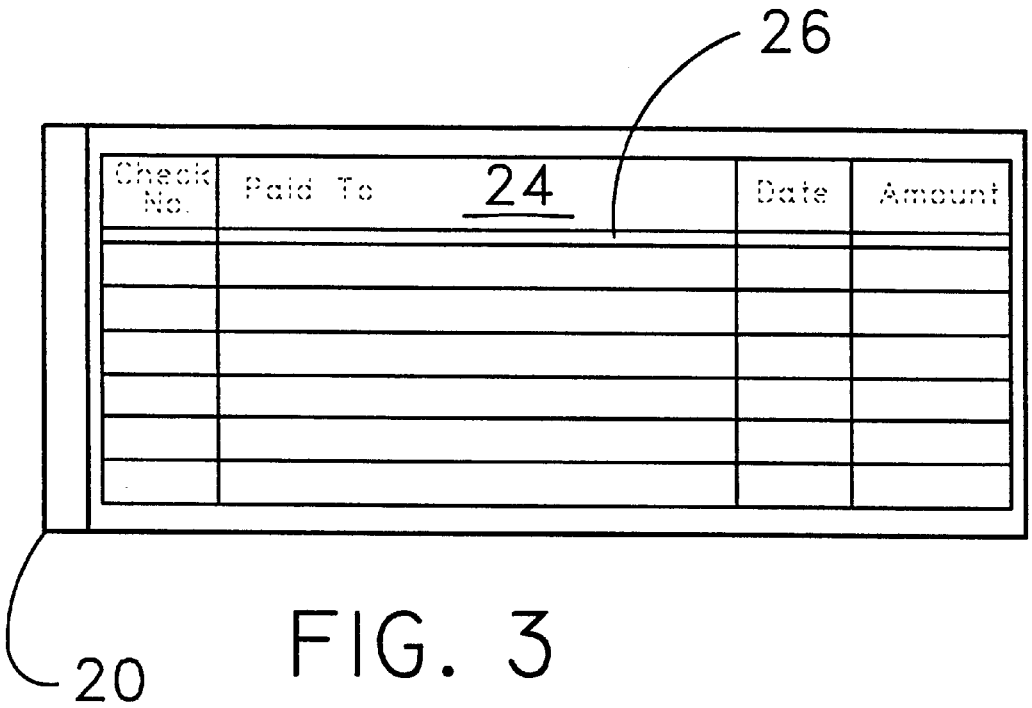
FIG. 3 is a schematic rear view of the present invention.
Figure 4:
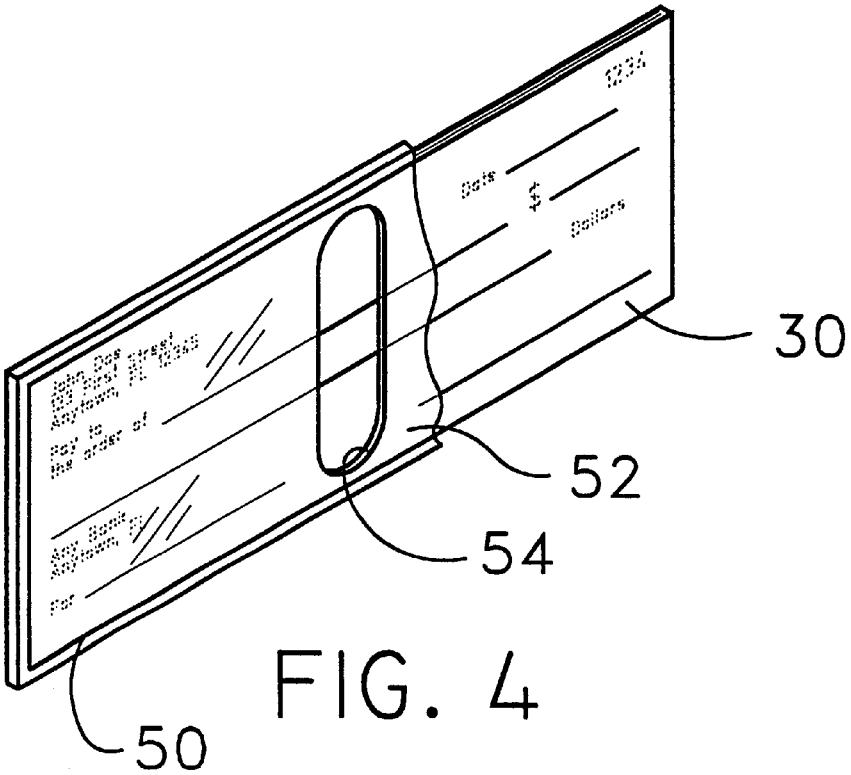
FIG. 4 is a schematic perspective view of the present invention.

With reference now to the drawings, and in particular to FIGS. 1 through 4 thereof, a new check writing system embodying the principles and concepts of the present invention and generally designated by the reference numeral 10 will be described.

As best illustrated in FIGS. 1 through 4, the check writing system 10 generally comprises a main cover member 20, a plurality of check blanks 30, and a front cover member 40.

The main cover member 20 includes a front surface 22 and a back surface 24. The main cover member 20 substantially provides rigidity for the check writing system.

Each one of the plurality of check blanks 30 is detachably coupled to the main cover member 20.

The front cover member 40 is coupled to the main cover member 20. The front cover member 40 provides protection for the plurality of check blanks 30 from creasing, stray marks, and wear due to rubbing. The front cover member 40 is substantially transparent.

The main cover member 20 further comprises a back surface 24, which includes a register 26 for recording information for each of the plurality of checks 30 as they are written. Such information may include payee, date, amount, balance forward, and category.

In an embodiment the plurality of checks 30 comprises 6 checks.

In a further embodiment the back cover 20, the plurality of checks 30, and the front cover 40 all are coupled together by a heat pressed binding.

A wallet member 50 provides protection from moisture for the main cover member 20 and the plurality of checks 30. In an embodiment the wallet member 50 comprises a substantially transparent material.

The wallet member 50 further comprises a front wall 52, which includes an aperture 54 that is positioned medially. The aperture 54 provides access to the front cover member 40 for facilitating removal of the main cover member 20, front cover member 40, and the plurality of check blanks 30 from the wallet member 50.

In use, the plurality of checks along with the covers are either placed in the wallet member or in a separate wallet carried by the user. The checks are limited in number and fit well in a wallet eliminating the need to carry both a wallet and a separate checkbook.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A check writing system comprising:

a main cover member having a front surface and a back surface, said main cover member substantially providing rigidity for said check writing system;

a plurality of check blanks, each one of said plurality of check blanks being detachably coupled to said main cover member;

a front cover member coupled to said main cover member, said front cover member providing protection for said plurality of check blanks from creasing, stray marks, and wear due to rubbing;

a wallet member providing protection from moisture for said main cover member and said plurality of checks;

said wallet member having a generally rectangular front wall having an elongate aperture positioned medially, said elongate aperture having opposite sides spaced apart whereby said elongate aperture is adapted for permitting contact with said front cover member through said elongate aperture by a digit of a user for facilitating removal of said main cover member by frictional engagement of the digit with said front cover member to remove said front cover member and said plurality of check blanks from said wallet member, said elongate aperture being oriented such that a longitudinal axis of said elongate aperture extends transverse to a longitudinal axis of said front wall for facilitating sliding of the digit within said elongate aperture transversely with respect to said longitudinal axis of said front wall.

2. The check writing system of claim 1, wherein said main cover member further comprises:

a back surface having a register for recording information for each of the plurality of checks as they are written.

3. The check writing system of claim 1, wherein said front cover member being substantially transparent.

4. The check writing system of claim 1, wherein said plurality of checks comprises 6 checks.

5. The check writing system of claim 1, wherein said back cover, said plurality of checks, and said front cover all being coupled together by a heat pressed binding.

6. The check writing system of claim 1, wherein said wallet member comprises a substantially transparent material.

7. A check writing system comprising:

a main cover member having a front surface and a back surface, said main cover member substantially providing rigidity for said check writing system;

a plurality of check blanks, each one of said plurality of check blanks being detachably coupled to said main cover member;

a front cover member coupled to said main cover member, said front cover member providing protection for said plurality of check blanks from creasing, stray marks, and wear due to rubbing;

said main cover member further comprises a back surface having a register for recording information for each of the plurality of checks as they are written, such as payee, date, amount, balance forward, category;

said front cover member being substantially transparent;

wherein said plurality of checks comprises 6 checks;

wherein said back cover, said plurality of checks, and said front cover all being coupled by a heat pressed binding;

a wallet member providing protection from moisture for said main cover member and said plurality of checks;

wherein said wallet member comprises a substantially transparent material; and said wallet member having a generally rectangular front wall having an elongate aperture positioned medially, said elongate aperture having opposite sides spaced apart whereby said elongate aperture is adapted for permitting contact with said front cover member through said elongate aperture by a digit of a user for facilitating removal of said main cover member by frictional engagement of the digit with said front cover member to remove said front cover member and said plurality of check blanks from said wallet member, said elongate aperture being oriented such that a longitudinal axis of said elongate aperture extends transverse to a longitudinal axis of said front wall for facilitating sliding of the digit within said elongate aperture transversely with respect to said longitudinal axis of said front wall.

* * * * *